US006778675B2

(12) United States Patent
Maruo

(10) Patent No.: US 6,778,675 B2
(45) Date of Patent: Aug. 17, 2004

(54) SPEAKER DEVICE

(76) Inventor: Yoshito Maruo, 84-1, Ooaza Kakenoue, Sakado-ski, Saitama 350-0254 (JP)

( * ) Notice: Subject to any disclaimer, the term of this patent is extended or adjusted under 35 U.S.C. 154(b) by 0 days.

(21) Appl. No.: 10/054,654

(22) Filed: Jan. 22, 2002

(65) Prior Publication Data

US 2002/0097886 A1 Jul. 25, 2002

(30) Foreign Application Priority Data

Jan. 22, 2001 (JP) ..... 2001-053118
Dec. 18, 2001 (JP) ..... 2001-385088

(51) Int. Cl.[7] ..... H04R 25/00

(52) U.S. Cl. ..... 381/335; 381/336; 381/184; 381/186

(58) Field of Search ..... 381/300, 303–305, 381/307, 335–336, 349–351, 345, 184, 186, 386; 181/199, 144–145, 154

(56) References Cited

U.S. PATENT DOCUMENTS

| | | | | |
|---|---|---|---|---|
| 3,582,553 A | | 6/1971 | Bose | |
| 3,824,343 A | * | 7/1974 | Dahlquist | 381/335 |
| 3,927,261 A | * | 12/1975 | Dahlquist | 381/335 |
| 4,006,311 A | * | 2/1977 | Carlsson | 381/300 |
| 4,348,549 A | | 9/1982 | Berlant | |
| 4,580,654 A | | 4/1986 | Hale | |
| 4,882,760 A | * | 11/1989 | Yee | 381/335 |

FOREIGN PATENT DOCUMENTS

SE 1012505 12/1965

OTHER PUBLICATIONS

Supervised by Tamon Sahaku, "Speaker and Enclosure Encyclopedia," Seibunndo Shinkousha, Sections 2–3, 2–8, and 2–25, 1979.
John Argle, "Handbook of Recording Engineering," Stereo Sound, USA Macintosh, Additional Edition, Section 1, 1986.
Masanori Hayashi, "Speaker System which Anyone can Make" Keigaku shuppansha, 1983.
PE–16M Operational Manual, Pioneer Co. Ltd., 1998.
Ken Suzuki, "Basic Knowledge Related to Special Sound," Stereo Sound, USA Macintosh, vol. 84, pp. 105–107, 1987.
Yuzuru Tominari, "Super Stereo Theory," Sound Stereo, USA Macintosh, vol. 127, 1998.
Sound Stereo, USA Macintosh, vol. 59, Jan. 1998.
John Argle, "Handbook of Recording Engineering," Stereo Sound, USA Macintosh, Section Four, Fig. 4–26.

* cited by examiner

*Primary Examiner*—Curtis Kuntz
*Assistant Examiner*—P. Dabney
(74) *Attorney, Agent, or Firm*—Ladas & Parry

(57) ABSTRACT

In a speaker device including a plurality of speakers outputting different frequency bands, for a listener listening to sound from the speaker device, a first emitting direction of a first speaker emitting a high frequency band is oriented toward the listener more than a second emitting direction of a second speaker emitting a low frequency band.

6 Claims, 10 Drawing Sheets

SPEAKER DEVICE

BACKGROUND OF THE INVENTION

1. Field of the Invention

The present invention generally relates to a speaker device, and more particularly to the speaker device used in a room.

2. Description of the Related Art

Conventionally, a speaker device includes of a plurality of speakers, as a speaker system. A multi-way speaker system is used widely in that each speaker outputs a sound signal divided into frequency bands by such as a low-pass filter, a middle-pass filter, and a high-pass filter.

It is possible to widely filter frequency bands reproducible by the speaker device, by outputting for every frequency band using a plurality of speakers.

A conventional speaker device will now be described with figures.

FIG. 1 is a diagram showing an example of a configuration of the conventional speaker device.

In the conventional speaker device 1 in FIG. 1, a loudspeaker unit 6 includes a woofer 3 (speaker for low-pitched sound), a squawker 4 (speaker for middle-pitched sound), and a tweeter 5 (speaker for-high-pitched sound) in an enclosure 2. And the woofer 3, a squawker 4, and the tweeter 5 are positioned on a baffle plate 7 (front wall). And a network is provided at the rear wall of the enclosure 2 to connect an input terminal for an amplifier connection with the loudspeaker unit 6.

Generally, two conventional speaker devices 1 are provided at a right side and a left side in that two loudspeaker units 6 are spaced and positioned at a predetermined distance so as to face a listener. A flow of a sound wave in the case in which the listener listens to sound from the conventional speaker device 1 installed in a room will now be explained with reference to FIG. 2.

FIG. 2 is a diagram showing an example of the flow of the sound wave from the conventional speaker device.

In FIG. 2, the conventional speaker device 1 is provided in a room, and the woofer 3, the squawker 4, and the tweeter 5 are directly positioned toward the listener 9.

Since the conventional speaker device 1 is a direct emission type, the listener 9 can obtain a feeling of an extent of a certain amount of sound.

However, although the sound wave output from the conventional speaker device 1 can obtain the feeling of an extent of sound, a rising of sound is slower. In order to improve a slowness of rising of the sound, a horn can be attached in each loudspeaker unit 6 of the conventional speaker device 1. However, if the horn is attached in the conventional speaker device 1, the feeling of the extent of the sound cannot be obtained.

Thus, the conventional speaker device 1 has a problem such that the feeling of the extent of the sound and a faster rising of the sound can not be realized at once.

FIG. 3 is a diagram showing an example of the responsibility of an impulse in a room.

Various sound waves such as a direct wave, an initial reflective wave, and a frequency reflective wave (reverberation) exist in space. The direct wave comes to the listener 9 in FIG. 2 first. And mainly since the initial reflective wave comes from both side walls, as compared with the direct wave, the initial reflective wave delays and comes to listener 9 at a wide angle. Moreover, the high order reflective wave randomly arrives at the listener 9 from various directions by being repeatedly reflected surrounding walls. Delay of the high order reflective wave causes a broad attenuation pattern, more than the initial reflective wave.

A complex combination in spatial three dimensions of the sound waves mentioned above gives the listener 9 the feeling of an extent of rich sound with a grand feeling of scale.

However, since a sound pressure of the direct sound from the loudspeaker unit 6 attached to a single planar baffle plate (front wall) 7 becomes higher in the conventional speaker device 1, compared with the initial reflective wave and a high order reflective wave, the sound pressure of direct sound masks sound by the initial reflective wave and the high order reflective wave. Moreover, since the direct wave, the initial reflective wave, and the high frequency reflective wave simultaneously reach the listener 9, the sound becomes monotony without a time difference.

Moreover, a multi-way speaker system such as the conventional speaker device 1 differs from systems where sound is output from one place, in that one musical sound and one voice are output from different speakers, respectively, and then the sound arrives at the listener 9. Thus, the listener 9 ends up listening to the sound as unnatural sound.

As described above, the conventional speaker device 1 cannot correctly reproduce original sound and sound field information.

FIG. 4 is a diagram showing an example of a directional sensitivity characteristic of the loudspeaker unit. A directional sensitivity characteristic indicates a frequency response at an angle off of a reference axis of the conventional speaker device 1. In FIG. 4, the directional sensitivity characteristic has angles of 0 degree, 30 degrees, and 60 degrees from a reference axis. At measurement points each of which is at an equal distance from a point on a reference axis, a result is shown in that each of the frequency responses is measured under the same condition.

Referring to FIG. 4, a sensitivity characteristic of each loudspeaker unit 6 is different for every directivity. If a frequency band is a higher sound range (higher pitched sound), the sensitivity in the angle out of the reference axis is deteriorated. On the other hand, since the frequency band is a higher sound range, the wavelength becomes shorter. Compared with other frequency bands, there is a larger amount of sound information in the simultaneous time domain. Considering this state, in order to reproduce the original sound and the sound field information without degrading the tone quality in the high-pitched sound range, a new speaker device is needed in that the high-pitched sound range precedes the others so as to reach the listener 9 first.

SUMMARY OF THE INVENTION

It is a general object of the present invention to provide a speaker device in which the above-mentioned problems are eliminated.

A more specific object of the present invention is to provide the speaker device in which original sound and sound field information can be correctly reproduced.

In order to overcome the problems mentioned above, the present invention provides means for overcoming the problems as follows:

From a first aspect of the present invention, the above objects are achieved by a speaker device including a plurality of speakers outputting different frequency bands, wherein for a listener listening to sound from the speaker device, a first emitting direction of a first speaker emitting a high frequency band is oriented toward the listener more than a second emitting direction of a second speaker emitting a low frequency band.

According to the present invention, it is possible for the high frequency band having a shorter wavelength and a dull directivity to arrive at the listener faster than the low frequency band emitted from other speakers. Therefore, it is possible for high-pitched sound to obtain precedence.

From a second aspect of the present invention, the above objects are achieved by a speaker device including a plurality of speakers outputting different frequency bands, wherein for a listener listening to sound from the speaker device, a first emitting direction of a first speaker emitting a high frequency band is located closer to the listener than a second emitting direction of a second speaker emitting a low frequency band.

According to the present invention, it is possible for the high frequency band having a shorter wavelength and a dull directivity to arrive at the listener faster than the low frequency band emitted from other speakers. Therefore, it is possible for high-pitched sound to obtain precedence.

From a third aspect of the present invention, in the speaker device as described as the first aspect, when the speaker device is seen from a top plan view, centers of opening parts of the plurality of the speakers are aligned on a single line.

According to the present invention, by aligning acoustic centers, the listener can obtain the feeling of a natural extent of the sound.

From a fourth aspect of the present invention, in the speaker device as described as the first aspect, at least two of centers of opening parts of the plurality of the speakers have a substantially identical height.

According to the present invention, the listener can clearly recognize an orientation of the acoustic image.

From a fifth aspect of the present invention, a speaker device including a plurality of speakers outputting different frequency bands, wherein the plurality of speakers include a woofer for a low-pitched sound, a squawker for a middle-pitched sound, a tweeter for a high-pitched sound, wherein the woofer is provided upward, the squawker is provided so as to have a predetermined inclination with respect to a listener listening to sound from the speaker device, and the tweeter is positioned toward the listener and is provided at a front most of the plurality of speakers.

According to the present invention, the directional sensitivity characteristic of the speaker is considered and the higher frequency band the more the speaker is directed to a listener side. By providing the speaker emitting the high frequency band at a position closer to the listener, it is possible for the high frequency band having a shorter wavelength and a dull directivity to arrive at the listener faster than the low frequency band emitted from other speakers. Therefore, it is possible for high-pitched sound to obtain precedence.

From a sixth aspect of the present invention, in the speaker device as described as the fifth aspect, the plurality of speakers includes a ribbon tweeter outputting a frequency band identical to that output from the tweeter for the high-pitched sound, the tweeter for the high-pitched sound and the ribbon tweeter are connected in series and are provided toward an opposite direction with respect to a horn of the woofer.

According to the present invention, by using the tweeter for the high-pitched sound and the ribbon tweeter in the same frequency band, the sound pressure in the high-pitched sound is raised. Moreover, by positioning the ribbon tweeter in an opposite direction of the tweeter, the directivities of the tweeter and the ribbon tweeter can be expanded by using the direct sound waves and the reflective sound waves. Furthermore, by connecting the tweeter and the ribbon tweeter in series, the high-pitched sound is expanded and it is possible to obtain the precedence of the high-pitched sound.

From a seventh aspect of the present invention, in the speaker device as described as the fifth aspect, the squawker and the tweeter are provided at a height substantially identical to that of ears of the listener.

According to the present invention, by arranging the squawker and the tweeter at the same height position as the ears of the listener, it is possible for the high-pitched sound to obtain precedence in time measured in milliseconds. Furthermore, the listener can recognize the orientation of the acoustic image clearly.

From an eighth aspect of the present invention, in the speaker device as described as the fifth aspect, bass reflex ports are provided to the horn.

According to the present invention, the sound from the bass reflex ports and other sound from other speaker units become a single harmonized sound. Therefore, it is possible to provide a three-dimensional feeling of a sound field to the listener. Moreover, it is possible to produce howling sound by simultaneously colliding several kinds of sound with each other.

BRIEF DESCRIPTION OF THE DRAWINGS

Other objects, features, and advantages of the present invention will become more apparent from the following detailed description when read in conjunction with the accompanying drawings, in which.

DESCRIPTION OF THE PREFERRED EMBODIMENT

An embodiment will be described according to the present invention with reference to figures.

Figure 1:
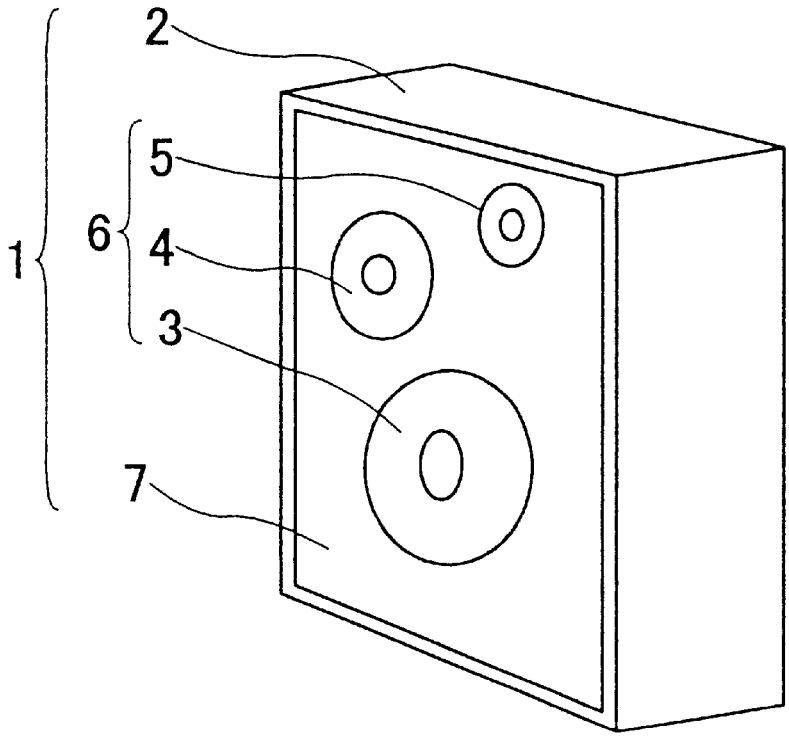
FIG.1 PRIOR ART
FIG. 1 is a diagram showing an example of a configuration of a conventional speaker device.
Figure 2:
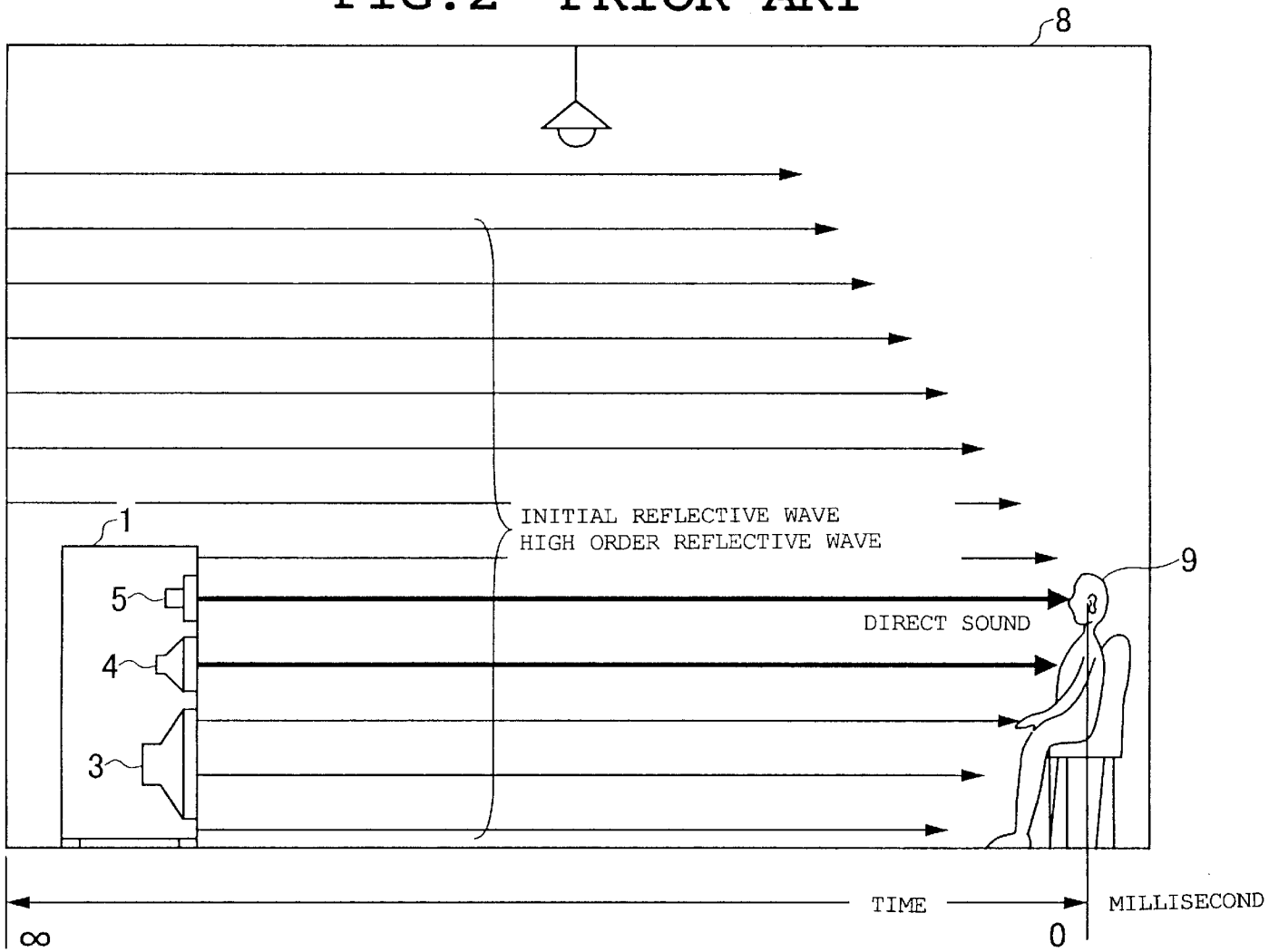
FIG.2 PRIOR ART
FIG. 2 is a diagram showing an example of a flow of a sound wave from the conventional speaker device.
Figure 3:
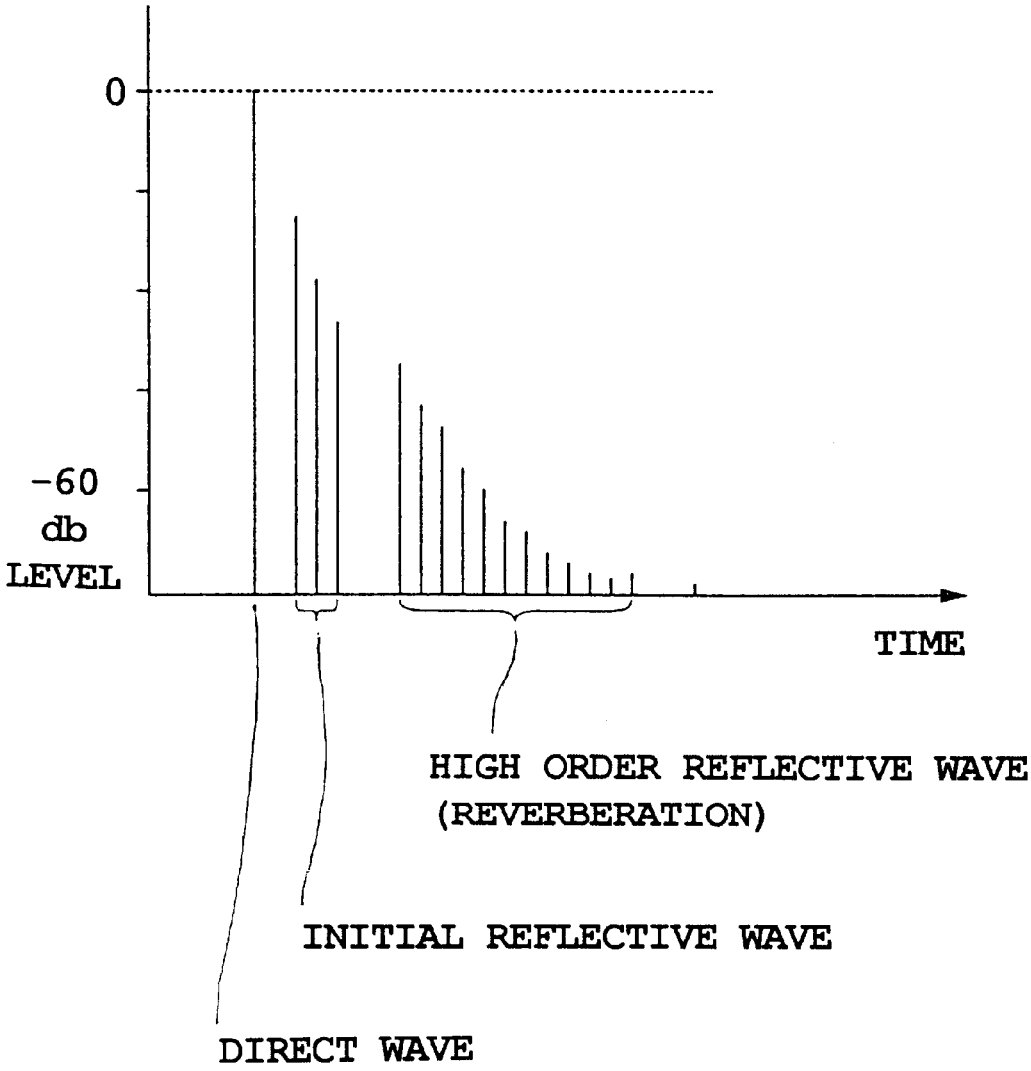
FIG. 3 is a diagram showing an example of a responsibility of an impulse in a room.
Figure 4:
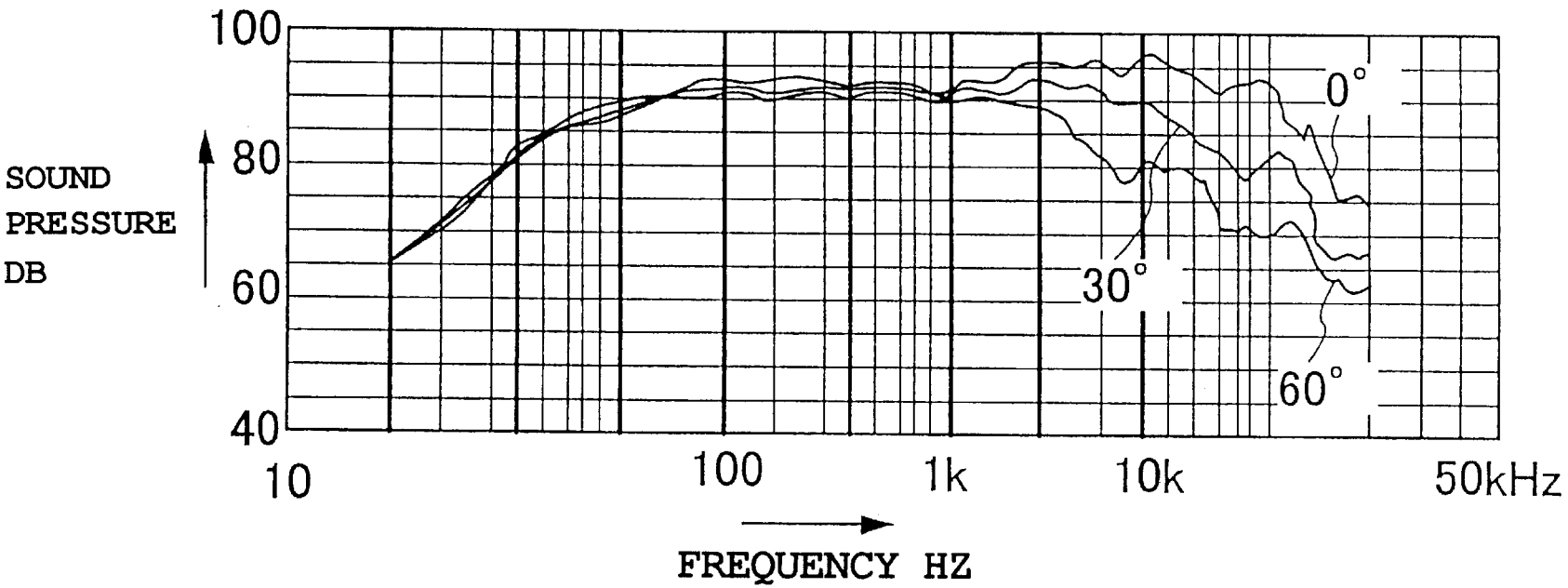
FIG. 4 is a diagram showing an example of a directional sensitivity characteristic of a loudspeaker unit.
Figure 5:
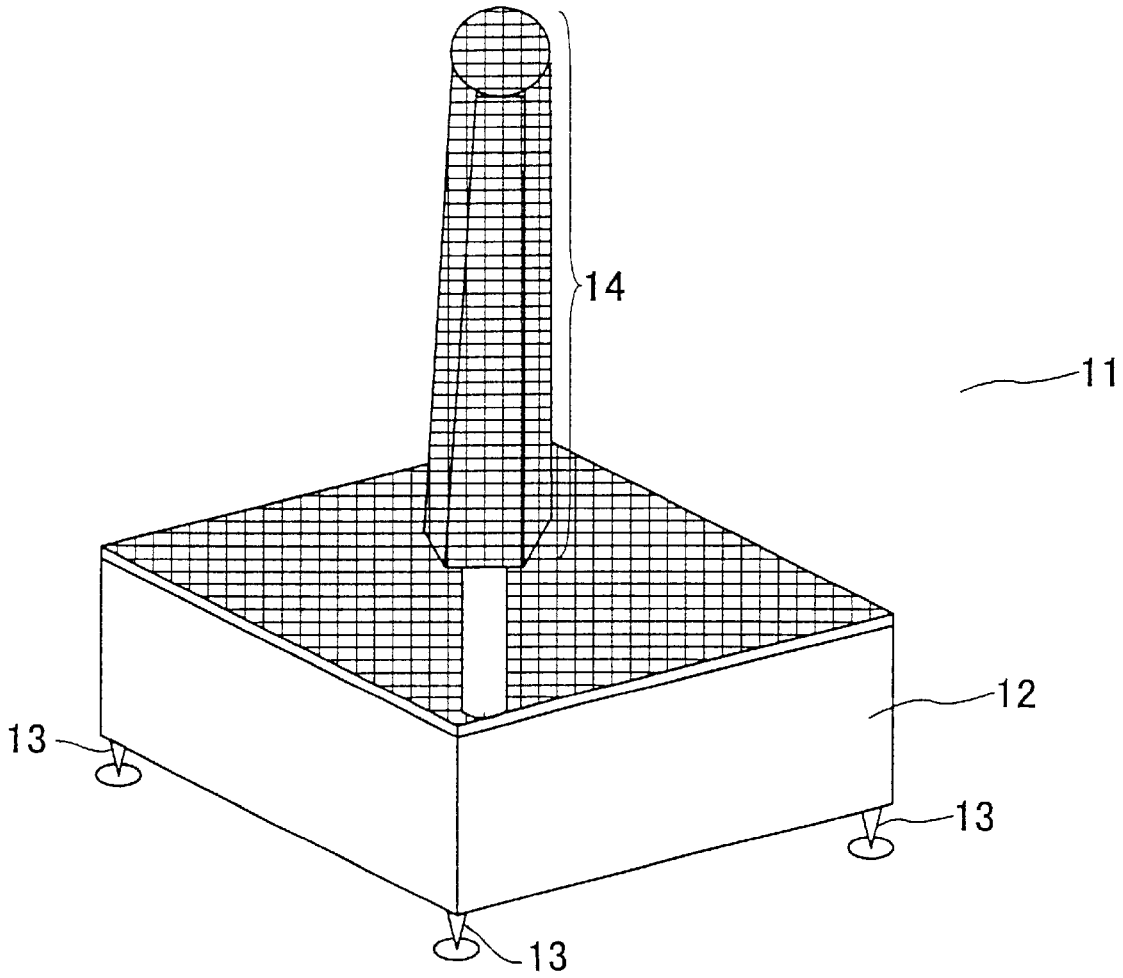
FIG. 5 is a diagram showing an appearance of a speaker device according to an embodiment of the present invention.

FIG. 5 is a diagram showing an appearance of a speaker device according to the embodiment of the present invention.

A speaker device 11 in FIG. 5 includes an enclosure 12, conical foot parts 13, and a speaker part 14 for middle-pitched sound and high-pitched sound.

Figure 6:
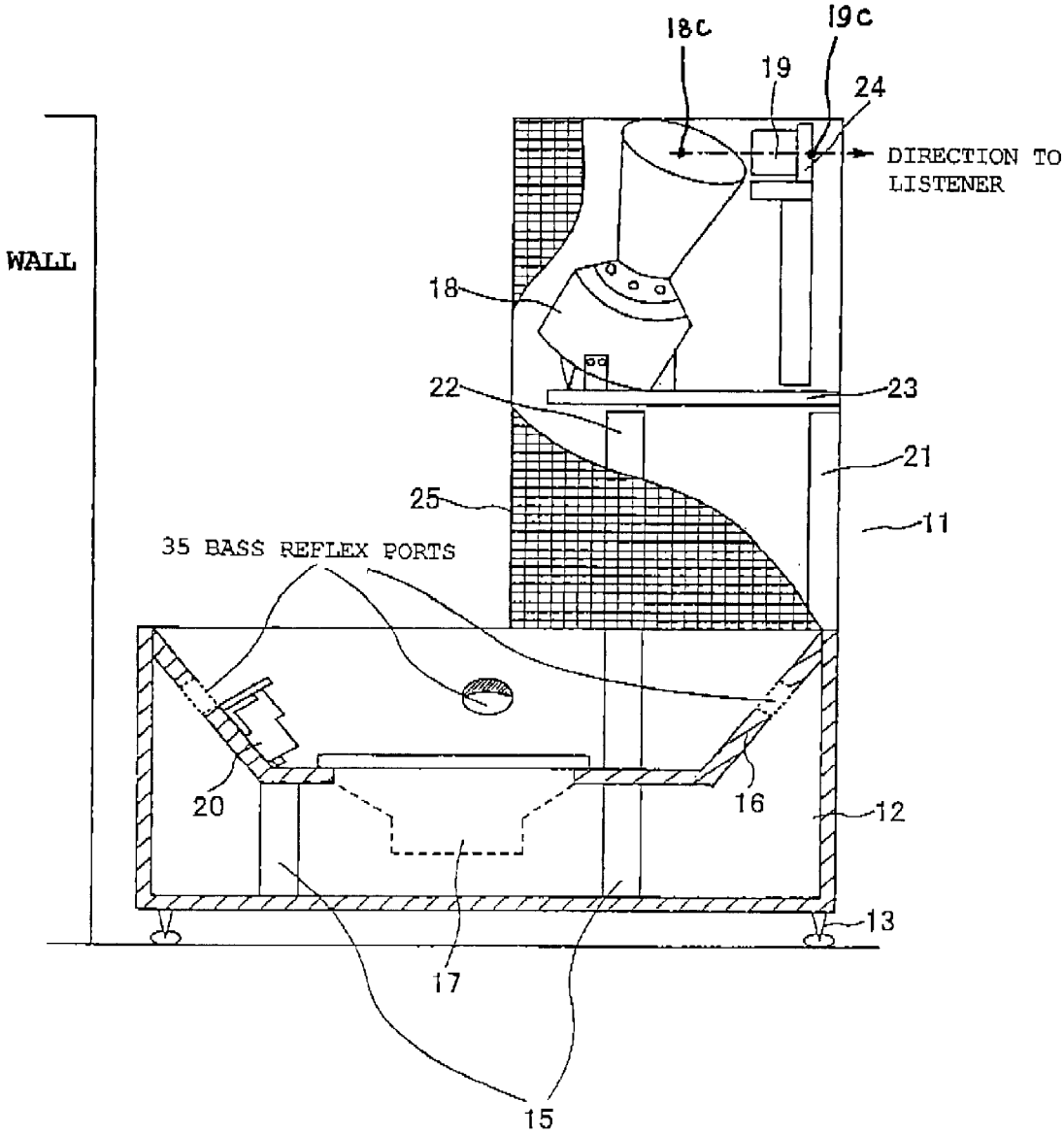
FIG. 6 is a diagram showing an example of a side elevational view in which the speaker device in FIG. 5 is partially sectioned.

FIG. 6 is a diagram showing an example of the side elevational view in which the speaker device in FIG. 5 is partially sectioned. The speaker device 11 of FIG. 6 includes an enclosure 12, conical foot parts 13, supporting parts 15, a low-pitched sound horn 16, a low-pitched sound woofer 17, a middle-pitched sound squawker 18, a high-pitched sound tweeter 19, a ribbon tweeter 20, columns 21 and 22, a fixed board 23, a fitting board 24, and a saran net 25.

In the speaker device 11 of FIG. 6, an emitting method of an all horn type is applied in order to improve rising of sound.

In FIG. 6, in order to arrive at an ear position of the listener 9, in the tweeter 19 having the strongest directivity toward a direction of a main axis and outputting the high-pitched sound wave, the columns 21 and 22 are provided outside the enclosure 12. Moreover, the fixed board 23 and the fitting board 24 are provided on columns 21 and 22. The tweeter 19 is attached to the fitting board 24 so as to position directly toward the listener 9 at a front of the speaker device 11. By arranging as described above, the sound wave of the high-pitched sound range of the tweeter 19 arrives at the listener 9 faster than other conventional speakers. The speaker device 11 of the present invention can be considered as the speaker system in that the high-pitched sound range is preceded.

Since the squawker 18 outputs the sound wave of the middle-pitched sound range which is in the middle between the low-pitched sound range and the high-pitched sound range, the directivity of the sound wave output from the squawker 18 also is in the middle between directivities in the low-pitched sound range and the high-pitched sound range. Then, the squawker 18 is provided at a predetermined angle with respect to a side of the listener 9. The squawker 18 of FIG.6 is inclined at a 14 degree angle in a vertical direction with respect to the side of listener 9. An inclination angle of 14 degrees is an angle obtained by trials. But the inclination angle is not limited to the 14 degrees to provide the squawker 18 and a tolerance is preferably more than zero degrees and less than 37 degrees.

It should be noted that a height of a central point of a horn opening part of the squawker 18 should be the same height as a center of the tweeter 19 seen from the side face. By arranging as described above, an orientation of a sound source can be defined by adjusting a location of the sound source of the high-pitched sound and the middle-pitched sound.

Since the woofer 17 outputting the sound wave of the low-pitched sound range has a weak directivity, the woofer 17 is provided upward in the enclosure 12.

Moreover, four bass reflex ports 35 are provided to four sidewalls of the low-pitched sound horn 16. In addition, the ribbon tweeter 20 is provided at an opposite direction of the tweeter 19 and emits the sound wave toward the opposite direction of the tweeter 19 so that a reflective wave can reach the listener 9. That is, the tweeter 19 and the ribbon tweeter 20 are positioned in the opposite direction so that the directivity becomes extandable by the direct wave and the reflective wave. Moreover, the sound pressure is raised by using the same frequency band. Furthermore, by connecting in series on a network, the high-pitched sound range is extended and the high-pitched sound range achieves precedence.

The low-pitched sound, a middle-pitched sound, and a high-pitched sound are harmonized in a space inside or above the low-pitched sound horn 16. Individual sounds output from the woofer 3, the squawker 4, and the tweeter 5 become a single harmonized sound. It is possible to provide a three-dimensional feeling of a sound field to the listener 9. Moreover, it is possible to produce howling sound by simultaneously colliding several kinds of sound with each other.

Since the ribbon tweeter 20 uses a ribbon method, the ribbon tweeter 20 can output sound up to a super-high-pitched sound range. However, since an excessive characteristic is lower, the ribbon tweeter 20 is not used as to produce a direct wave, but is used to output the initial reflective wave or the higher frequency reflective wave.

The conical foot parts 13 clarify sound from the speaker device 11 so as not to give vibrations from the woofer 3, the squawker 4, and the tweeter 5 to a floor.

An assembling method for assembling parts of the loudspeaker unit of the speaker device 11 according to the present invention will be described in detail with reference to FIG. 7.

Figure 7:
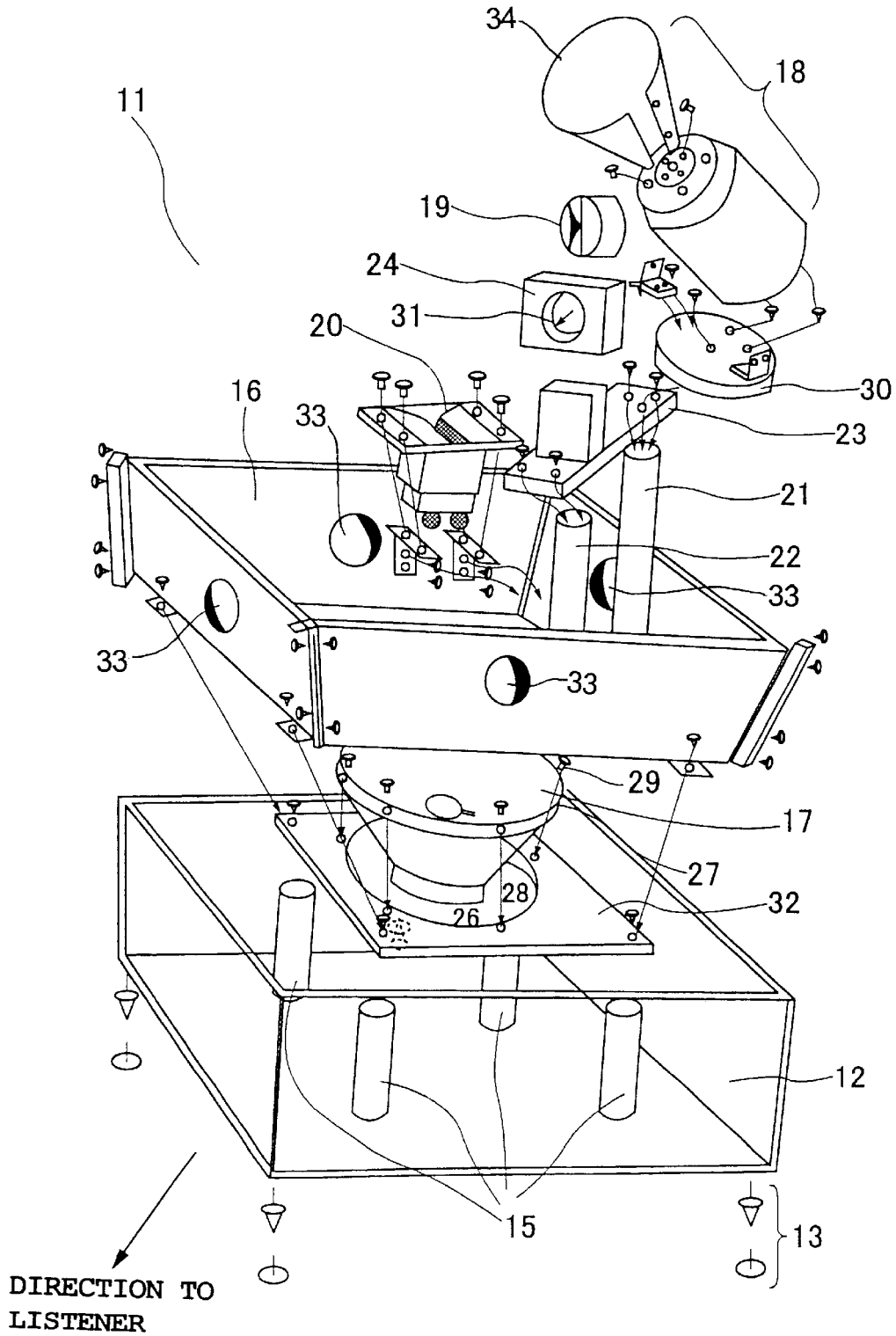
FIG. 7 is a perspective diagram showing a decomposition example of a loudspeaker unit according to the embodiment of the present invention.

FIG. 7 is a perspective diagram showing a decomposition example of the loudspeaker unit according to the present invention.

In FIG. 7, the woofer 17 is attached to a fixing hole 26 provided to a baffle plate 32 that is cut to a predetermined length, and is positioned so that only the thickness of the periphery part 27 of the woofer 17 protrudes upwards from the baffle plate 32. The woofer 17 is fixed by using bolts 29 to a plurality of screw holes 28 provided to the periphery part 27.

The four sidewalls of the low-pitched sound horn 16 are cut to a predetermined length, and holes are made for the bass reflex ports 33 on the four sidewalls of the low-pitched sound horn 16 and for one of the supporting parts 15, which one supports the tweeter 19, on a bottom board of the low-pitched sound horn 16. And the four sidewalls and the bottom board are fixed by nails and bonded. Moreover, the baffle plate 32 cut to the predetermined length is fixed with wood screws (not shown) and bonded. In this example, each diameter of the holes for the bass reflex ports is set to Φ (phi) 90 mm, but a diameter size of the holes is not limited to 90 mm.

The low-pitched sound horn 16 made as described above is adjusted to position on the enclosure 12 and fixed using the four supporting parts 15 under the baffle plate 32. Furthermore, the low-pitched sound horn 16 for low-pitched sound is also bonded to the enclosure 12 at a contact section.

A volume of the enclosure 12 is more than 100 liters and an upper limit of height including the low-pitched sound horn 16 is preferably set at less than 600 mm so as to secure the feeling of the extent of sound.

In the low-pitched sound horn 16, one side of a lower opening part is the same 400 mm as the periphery of the woofer 17, one side of an upper opening part is 500–750 mm, a height is 250 m, and a degree of an inclination angle is set at 110 degrees to 130 degrees.

The columns 21 and 22, which maintain the fixing of the squawker 18 and the tweeter 19 at a predetermined height, is set 300–400 mm in height, and a horn 34 used for the squawker 18 is made from a vinyl chloride board or an aluminum board.

The entire shape of the horn 34 is conical, a lower opening part has the same length as the periphery of a throat of a compression driver, and an upper opening part is set to the same length as one sound wave in the frequency at a boundary between the low-pitched sound and the middle-pitched sound. Moreover, the height of the horn 34 is set to at 170 mm.

A circular board 30 is made to attach and fix the horn 34 to the compression driver. A diameter of the circular board 30 is set to the same size as a packing stuck on the compression driver, and an inside hole is made which diameter is slightly larger than that of the throat of the compression driver. Furthermore, the hole to be fixed by a bolt is made and bonded to the horn 34.

The squawker 18 is arranged frontward with a 14 degree angle from the vertical direction of the speaker device 11 through the circular board 30 at a rear side of the fixed board 23. The circular board 30 is fixed at a center thereof by a wood screw. L-shaped metal fitting members are attached in both sides for drop prevention.

A center of a horn opening part of the squawker 18 is positioned at the same height from the floor as the center of the tweeter 19. Accordingly, it is possible to output the sound from a predetermined location without outputting from various different locations, so that an acoustic image is oriented.

The tweeter 19 is located at the front position on the enclosure 12 and the height of the front opening part is set to 1050 mm from the floor. The tweeter 19 is engaged by a fixing hole 31 provided to the fitting board 24 so as to arrange the front opening part to direct the front.

The ribbon tweeter 20 is located in the low-pitched sound horn 16 and the degrees of an emitting angle is set to the same (110 degrees to 130 degrees) as that of the low-pitched sound horn 16. Then, the ribbon tweeter 20 is fixed by the L-shaped metal fitting members.

In addition, the ribbon tweeter 20 is connected with the tweeter 19 in series on a network in the front row. Thereby, the same frequency band can be easily output from the tweeter 19 and the ribbon tweeter 20 and the sound pressure and the directivity of the high-pitched sound range achieves precedence. Since the ribbon tweeter 20 uses the ribbon method, the ribbon tweeter 20 is used to reproduce the initial reflective wave and the high order reflective wave.

Moreover, in the speaker device 11, the saran net 25 is stretched to cover the upper opening part of the low-pitched sound horn 16, the tweeter 19, and the squawker 18. Furthermore, the height and the direction of the tweeter 19 is set to the height of ears of the listener 9.

Next, the network connecting the loudspeaker units to each other will be described according to the embodiment of the present invention with reference to FIG. 8.

Figure 8:
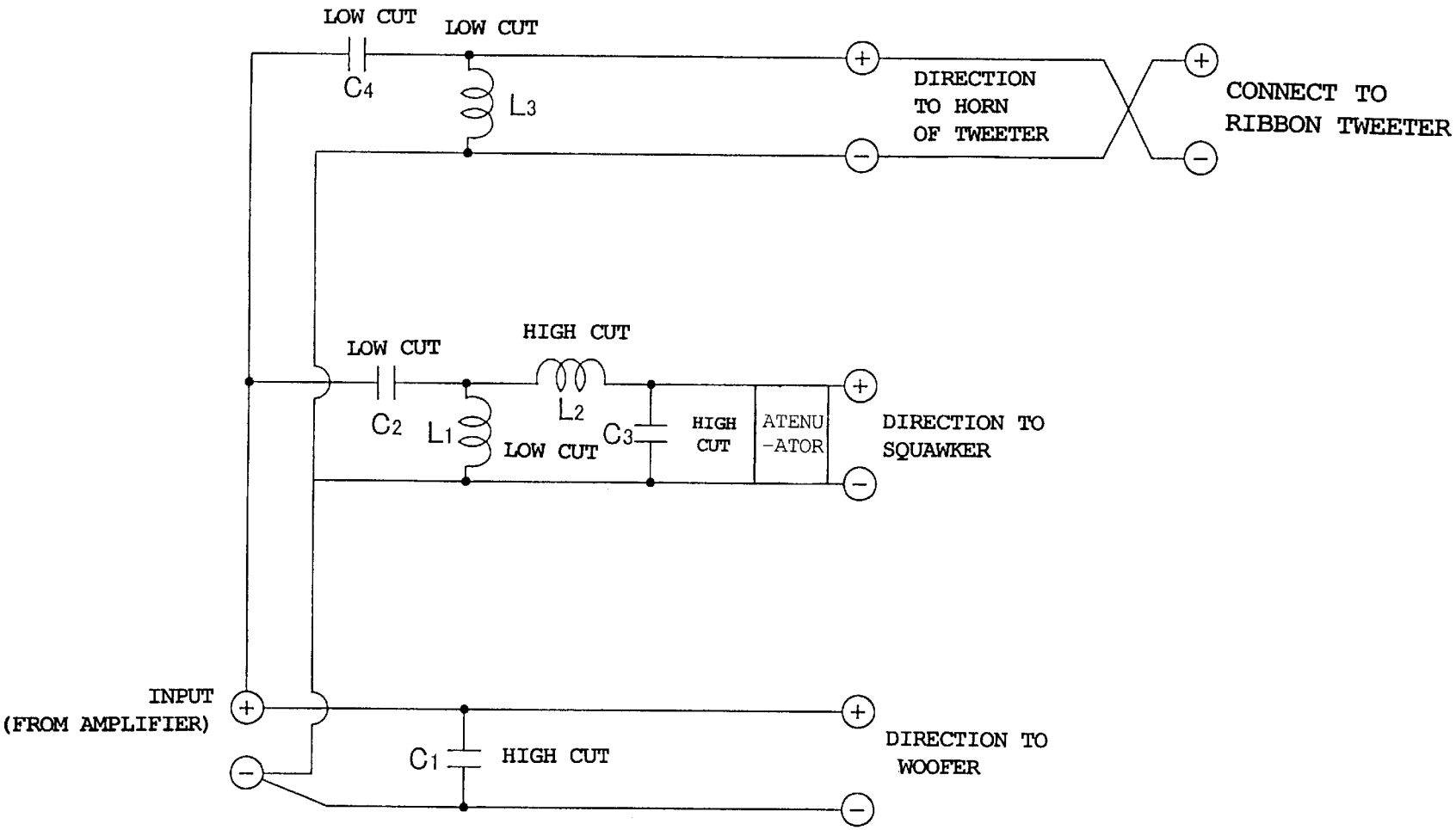
FIG. 8 is a diagram showing an example of a network circuit configuration according to the embodiment of the present invention.
Figure 9:
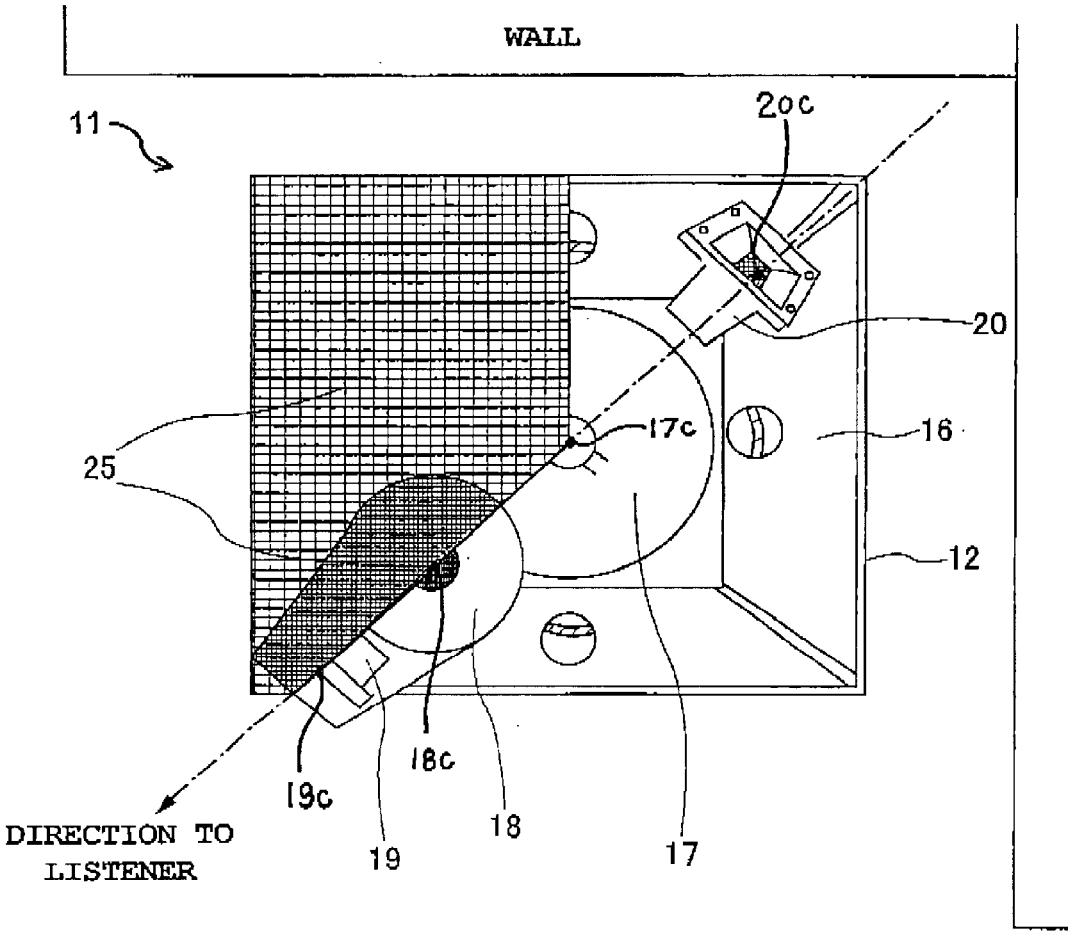
FIG. 9 is a plan view of the speaker device according to the embodiment of the present invention.

FIG. 8 is a diagram showing an example of a network circuit configuration according to the embodiment of the present invention.

In FIG. 8, an input signal from an amplifier is filtered to select frequencies and selected frequencies are supplied to speakers, respectively. In addition, condensers C1 through C4 are used for a low cut of frequencies or for a high cut of frequencies, and coils L1 through L4 are used for the low cut of frequencies or for the high cut of frequencies.

For the input signal toward the woofer 17, a coil which would reduce braking of the woofer 17 is eliminated and only a condenser is provided. Moreover, in order to prevent a counter-electromotive force from the woofer 17 degrading a tone quality of other units through an earth line of the network, a bi-wiring method is used to wire separately from the amplifier.

Centers 19*c*, 18*c*, 17*c*, 20*c*, of the opening parts of the tweeter 19, the squawker 18, the Woofer 17, and the ribbon tweeter 20 are aligned and then acoustic centers are also aligned. Therefore, it is possible to obtain the feeling of a natural extent of the sound. That is, as well as a precedence sound effectiveness achieved by the tweeter 19, it is possible for the listener 9 to properly recognize a direction of arriving sound.

Next, a flow of a sound signal will be described in a case of actually listening to sound from the speaker device 11 in the room, with reference to FIG. 10.

Figure 10:
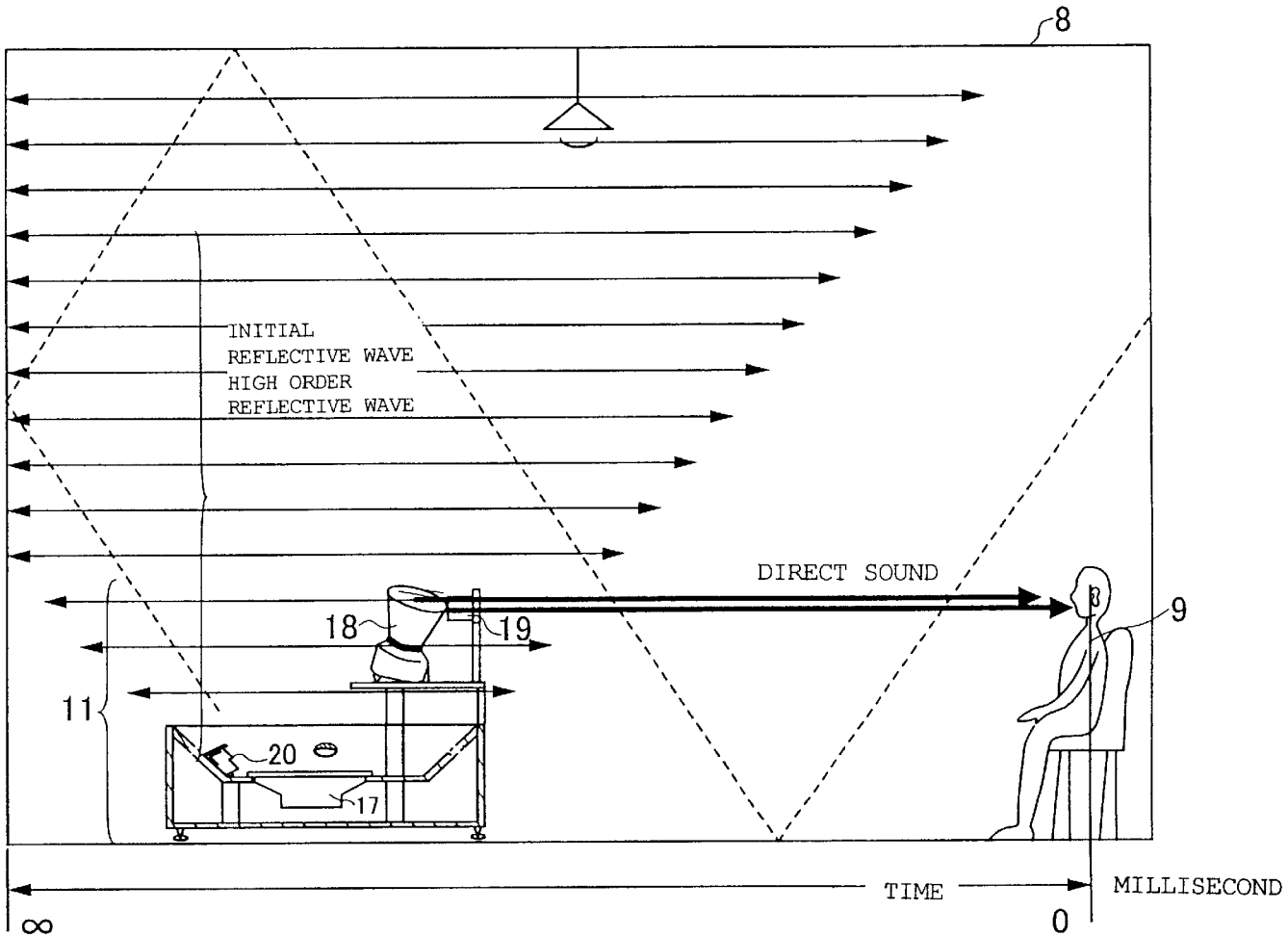
FIG. 10 is a diagram showing an example of the flow of the sound wave in the room, according to the embodiment of the present invention.

FIG. 10 is a diagram showing an example of the flow of the sound waves in the room, according to the embodiment of the present invention.

Referring to FIG. 10, the listener 9 listens to the direct sound from the tweeter 19 of the speaker device 11 first, and next, the listener 9 listens to the direct sound from the squawker 18. In this case, by the "precedence sound effectiveness" in that the listener 9 feels a sound source in the direction where the listener 9 hears the first sound, the listener 9 can recognize a place generating a sound source. That is, the orientation of the acoustic image can be recognized clearly.

Moreover, in the low-pitched sound horn 16 or in a space above the low-pitched sound horn 16, the low-pitched sound wave from a woofer 17, the high-pitched sound wave from the ribbon tweeter 20, and the middle-pitched sound wave from the squawker 18 are harmonized in a space field to become a single sound while having a time difference between the initial reflective wave and the high order reflective wave. Therefore, it is possible to provide the sound wave that is harmonized and gives the feeling of an extent of the sound to the listener 9. In addition, in the speaker device 11, since each speaker is a horn type, it is possible to improve rising of sound.

In the configuration of the speaker device 11 according to the embodiment of the present invention, several sound ranges from a single channel or various sounds from a right channel and a left channel are mixed so that a thickened sound is generated, and also collide with the direct sound, the reflected sound, and the reverberations so that the howling sound is generated by several kinds of sounds simultaneously colliding with each other. Accordingly, the listener 9 can experience the feeling of a grand scale of outstanding rich sound.

It should be noted that the embodiment described above is just one example. The present invention is not limited to the specifically disclosed embodiments, variations and modifications, and other variations and modifications may be made without departing from the scope of the present invention.

According to the present invention, an all horn type of speakers is applied to the emitting method of the sound of the loudspeaker unit. In addition to an improved rising of the sound, by adjusting an approaching time field for the sound signal output from a plurality of speakers so that the high-pitched sound range achieves precedence in arrangement of the speakers, it is possible to provide the speaker device 11 in which the sound source is harmonized and the feeling of the extent of the sound can be obtained.

Furthermore, by the "precedence sound effectiveness" in that the listener 9 feels a sound source in a direction from which the listener 9 first hears the sound, various sound sources gather to the speaker outputting the high-pitched sound frequency. Then, the listener 9 feels that the listener 9 hears various sounds of the sound of the low-pitched sound range and the middle-pitched sound range, even if the various sounds are not actually output. Accordingly, it is possible to listen to sound with a sense of togetherness.

Moreover, since the listener 9 can get the sound with an appropriate directivity, eardrums or bones of ears do not vibrate unnecessarily but natural sound can be obtained.

In addition to advantages described above, the speaker device 11 according to the present invention can correctly reproduce the original sound and the sound field information.

The present application is based on Japanese Priority Applications No. 2001-53118 filed on Jan. 22, 2001 and No. 2001-385088 filed on Dec. 18, 2001, the entire contents of which are hereby incorporated by reference.

What is claimed is:

1. A speaker device having a plurality of speakers outputting different frequency bands to a listener, the speaker device comprising:

a woofer having a woofer opening part for emitting a low-pitched sound;

a squawker having a squawker opening part for emitting a middle-pitched sound;

a tweeter having a tweeter opening part for emitting a high-pitched sound; and a ribbon tweeter located in a horn of the woofer for emitting a frequency band identical to that emitted from the tweeter for the high-pitched sound, wherein the woofer opening part is oriented upward, the squawker opening part is oriented in an angle so as to provide a predetermined inclination with respect to the listener;

the tweeter opening part is oriented toward the listener and the tweeter is positioned more closely to the listener than the woofer or the squawker, and the tweeter for the high-pitched sound and the ribbon tweeter are oriented in different directions with respect to each other.

2. The speaker device as claimed in claim 1, wherein when the speaker device is seen from the top, the centers of the woofer opening part, the squawker opening part, the tweeter opening part, and a ribbon tweeter opening part of the ribbon tweeter are substantially aligned in a single line.

3. The speaker device as claimed in claim 1, wherein the centers of the tweeter opening part is positioned at a height substantially identical to the height of the ears of the listener.

4. The speaker device as claimed in claim 1, wherein the squawker and the tweeter are positioned at a height substantially identical to the height of the ears of the listener.

5. The speaker device as claimed in claim 1, wherein the horn of woofer has bass reflex ports.

6. A speaker device having a plurality of speakers outputting different frequency bands to a listener, the speaker device comprising:

a woofer having a woofer opening part for emitting a low-pitched sound;

a squawker having a squawker opening part for emitting a middle-pitched sound;

a tweeter having a tweeter opening part for emitting a high-pitched sound; and a ribbon tweeter for emitting a frequency band identical to that emitted from the tweeter for the high-pitched sound, wherein the woofer opening part is oriented upward, the squawker opening part is oriented in an angle so as to provide a predetermined inclination with respect to the listener;

the tweeter opening part is oriented toward the listener and the tweeter is positioned more closely to the listener than the woofer or the squawker, and the tweeter for the high-pitched sound and the ribbon tweeter are oriented in different directions with respect to each other.

* * * * *